US007946688B2

(12) United States Patent
Kawase et al.

(10) Patent No.: US 7,946,688 B2
(45) Date of Patent: May 24, 2011

(54) RECORDING HEAD AND RECORDING APPARATUS

(75) Inventors: Junya Kawase, Yokohama (JP); Shinji Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 728 days.

(21) Appl. No.: 11/953,664

(22) Filed: Dec. 10, 2007

(65) Prior Publication Data

US 2008/0143783 A1 Jun. 19, 2008

(30) Foreign Application Priority Data

Dec. 13, 2006 (JP) ..... 2006-335656

(51) Int. Cl.
*B41J 2/05* (2006.01)

(52) U.S. Cl. ..... 347/65; 347/94; 347/63; 347/71

(58) Field of Classification Search ..... 347/63, 347/65, 71, 94, 87
See application file for complete search history.

(56) References Cited

U.S. PATENT DOCUMENTS

| | | | | |
|---|---|---|---|---|
| 5,682,190 | A * | 10/1997 | Hirosawa et al. | 347/94 |
| 5,963,234 | A | 10/1999 | Miyazawa | |
| 6,241,350 | B1 * | 6/2001 | Otsuka et al. | 347/94 |
| 6,457,821 | B1 * | 10/2002 | Liu et al. | 347/93 |
| 6,543,880 | B1 | 4/2003 | Akhavain | |
| 6,557,989 | B1 * | 5/2003 | Hirosawa et al. | 347/87 |
| 6,752,492 | B2 | 6/2004 | Hirosawa et al. | |
| 6,976,754 | B2 * | 12/2005 | Ohashi et al. | 347/92 |
| 7,229,162 | B2 * | 6/2007 | Okazawa | 347/84 |
| 2002/0196319 | A1 * | 12/2002 | Slenes et al. | 347/94 |
| 2008/0062226 | A1 * | 3/2008 | Urasaki | 347/65 |
| 2008/0143795 | A1 * | 6/2008 | Hayashi | 347/71 |

FOREIGN PATENT DOCUMENTS

| | | |
|---|---|---|
| JP | 6-210872 | 8/1994 |
| JP | 2001-130004 | 5/2001 |

* cited by examiner

*Primary Examiner* — Matthew Luu
*Assistant Examiner* — Henok Legesse
(74) *Attorney, Agent, or Firm* — Canon USA Inc IP Division

(57) ABSTRACT

A recording head includes a recording element substrate having a discharge port facilitating discharging a liquid droplet, an energy generating element configured to generate energy for liquid discharge, and a supply opening facilitating supplying the discharge port with a liquid. The recording head also has a support member having a supply path formed by laminating a plurality of plate-shaped members including an opening portion. The support member supports the recording element substrate and includes a chamber communicating with the supply path and adapted to hold air.

7 Claims, 12 Drawing Sheets

RECORDING HEAD AND RECORDING APPARATUS

BACKGROUND OF THE INVENTION

1. Field of the Invention

The present invention relates to a recording head and a recording apparatus, executing recording by discharging a liquid droplet.

2. Description of the Related Art

Recording apparatuses for executing a recording on a recording medium such as a paper, a cloth, a plastic sheet or an OHP sheet are known in various recording systems, such as a wire dot recording system, a thermal recording system, a thermal transfer recording system and an ink jet recording system.

Among these recording systems, the ink jet recording system utilizes discharging ink, according to recording information, from a fine hole for discharging ink (hereinafter called a discharge port), provided in an ink jet recording head (hereinafter simply called a recording head).

In an ink discharging operation in the recording head, pressure generated for the ink discharge propagates, through the ink in a flow path, in a direction toward the discharge port and in a direction toward a liquid chamber, that serves as an ink supply source to the flow path. By the function of pressure propagating toward the discharge port, the ink in the flow path is pushed out from the discharge port, thereby forming a flying liquid droplet.

When the ink leaves the discharge port as a liquid droplet, a meniscus formed in the flow path in the vicinity of the discharge port is retracted according to the amount of the discharged liquid droplet. Then, by an action of pulling back the meniscus toward the discharge port, the ink filling state in the flow path returns to a state prior to the discharge after the lapse of a certain time. This phenomenon is called "refilling", and, in the actual recording, the above-described operations are repeated and stable ink droplet discharges are obtained in a continuous manner by satisfactory refilling.

However, there may result a situation where the refilling is not executed in time for the next discharge, in relation for example with a discharge frequency. In the case that the ink discharge is executed in a state where the refilling is incomplete, there may result a discharge failure such as a decrease in the amount of the discharged ink droplet. As a result, a diameter of an ink dot, formed by the discharged ink droplet on the recording medium, decreases to result in a deterioration in the overall recording quality. Also the precision of the landing point of the discharged ink droplet on the recording medium may be deteriorated to induce defects such as blurring, a deviated recording, streaking, and white spots in the recorded image.

The above-described problems in the recording technology utilizing a liquid such as the ink jet recording system have been tried to be solved by an improvement in the structure such as the flow path or by adjusting the physical properties of the ink. However, in a recording head in which a plurality of discharge ports are arrayed, it is often not possible to obtain a sufficient effect by this structural improvement or adjustment. These problems will be described in the following, with reference to the accompanying drawings.

FIGS. 12A and 12B are views illustrating pressure resulting from the ink discharge in a direction toward the discharge port, and FIGS. 13A and 13B are views for describing the pressure necessary for obtaining a satisfactory refilling state. FIGS. 12A and 13A are plan views of a principal part of the recording head, and FIGS. 12B and 13B are cross-sectional views of the principal part seen from a discharge direction of the ink.

A recording head 100 includes a plurality of discharge ports (abbreviated in drawing), flow paths 102 respectively communicating with these discharge ports, a discharge energy generating element 103 disposed in each flow path 102, and a supply opening 104 for supplying the flow paths with the ink. The supply opening 104 communicates with an unillustrated ink tank (also called ink cartridge) through an ink supply path 105, whereby the supply opening 104 is constantly filled with the ink.

As illustrated in FIGS. 12A and 12B, in the case that the ink is discharged from a number of discharge ports at the same time or with a certain time difference, the pressure generated by the ink discharge in each flow path 102 propagates from each flow path 102 toward the supply opening 104. Such pressures are united in the supply opening 104 and become a single large pressure. The pressure generated in each flow path 102 functions as a force for pushing back the ink toward the supply opening 104 as indicated by an arrow A, and the sum of these forces becomes several times greater than in a recording head for example having only one discharge port.

In this case, in order to obtain a satisfactory refilling state, it is necessary, as illustrated in FIGS. 13A and 13B, to move the ink rapidly and in a large amount toward the discharge port (as indicated by arrows B). In order to realize this change in the moving direction of the ink, a pressure capable of overcoming the initial large inertial force (total pressure) of the ink is required.

However, the capillary force of ink, realizing the refilling in each flow path 102, is not sufficient for displacing a large amount of ink instantaneously toward the discharge port in opposition to the above mentioned total pressure toward the supply opening 104. Consequently, with an increase in the initial inertial force in the above mentioned ink displacement, a longer time is required for restoring the meniscus 106. Therefore, when the discharge frequency is lowered in order to obtain a sufficient time for the returning of the meniscus, the recording speed becomes lowered. On the other hand, when a sufficient time for the returning of the meniscus cannot be obtained, for example the discharged ink droplet cannot be obtained in a prescribed liquid amount, so that satisfactory recording is hindered. This phenomenon is known to be particularly conspicuous in an initial period of recording after starting of recording.

FIGS. 14A and 14B are views illustrating the mechanism of the above-described phenomenon, FIG. 14A illustrates curves indicating retraction of the meniscus, and FIG. 14B is a view illustrating a schematic constitution of the discharge port and the vicinity thereof.

In FIG. 14A, a retraction amount L [μm] of the meniscus indicated on the ordinate is represented, illustrated in FIG. 14B, by a distance L from an end portion of the discharge port 101 to the meniscus. More specifically, it corresponds to the distance from the discharge port 101 to the most retracted portion of the ink meniscus.

A curve CM1 in FIG. 14A, indicating the change in time of the meniscus retraction for example in a recording head having only one discharge port, indicates the following facts. After a certain period from a time t0 at which the energy from the discharge energy generating element 103 is applied to the ink in the flow path 102, the meniscus 106 formed in the vicinity of the ink discharge port of the flow path 102 starts to retract rapidly from a time t0'. Stated differently, the meniscus 106 starts to retract from a time when an ink discharge is executed. The amount of retraction, reaching maximum at a time t1', is relatively large. Thereafter, by the action of a returning force by the capillary force, the meniscus 106 starts to return to the original position, and the refilling is completed at a time t1.

On the other hand, in case of a recording head having a plurality of discharge ports, as represented by a curve CM2, the maximum retraction amount at the time t1' is smaller than in the above-mentioned case, but the refilling speed is lower as indicated by an ending time t2.

This is presumably because, as described above, the total sum of the pressures from the plural flow paths 102 to press the ink backwards significantly exceeds a pressure for causing an ink flow in the supply opening 104. More specifically, an excessive pressure, exceeding the pressure for causing an ink flow in the supply opening 104 acts on the ink, thereby extremely retarding, in an initial period, the refilling speed for returning the meniscus 106.

After the discharges are repeated in succession, the phenomenon described above infrequently occurs, since a stationary flow of ink is formed from the ink supply path 105 (cf. FIGS. 12A to 13B) to the supply opening 104. In fact, the above-described phenomenon occurs evidently in an initial period of the discharges, particularly until the discharging operation is repeated about 200 times thereby forming a stationary flow of the ink.

In a recording head having a plurality of discharge ports, the decrease in the refilling speed does not become a problem when a period of applications of print signals to the discharge energy generating element is selected equal to or longer than a period from the time t0 to t2 illustrated in FIG. 14A.

However, when the next signal is applied, for the purpose of a high-speed recording, with a period shorter than the period from the time t0 to t2, namely before the completion of refilling, there may result for example a decrease in the amount of discharged ink droplets whereby a satisfactory recording may become impossible. Stated differently, when a next signal is applied in a state where the retraction amount L of the meniscus is 30 μm or more, a decrease in the amount of the discharged ink droplets may result, whereby a satisfactory recording may become impossible.

In order to solve these problems, Japanese Patent Application Laid-Open No. H06-210872 discloses a construction having an air chamber (buffer chamber) at a rear side, opposite to the nozzle side with respect to the supply opening in the head unit. More specifically, in the disclosed construction, a buffer chamber is formed in a position close to the nozzle (array) to alleviate vibration (high-frequency vibration) of the liquid caused by the driving, bubbling, and discharging in an individual nozzle, thereby not detrimentally affecting other nozzles. Thus, Japanese Patent Application Laid-Open No. H06-210872 proposes to solve the above mentioned problems by preventing the crosstalk by the above-described construction.

Japanese Patent Application Laid-Open No. H06-210872 also discloses a construction of forming, in a path from the ink tank portion to the head portion, a buffer chamber which is formed in the head unit, in the ink supply tube for ink supply thereto, and in the connecting part of the two. In particular, FIGS. 12A and 12B illustrate a construction having a buffer chamber around the supply tube of a constant cross section.

In order to reduce the crosstalk by this buffer chamber, it is desirable that there should be a large number of buffer chambers in the vicinity of the nozzle array. In consideration of the structure of the recording head, a side face of the ink supply opening at the rear side of the recording element substrate or of the ink supply opening of an alumina base plate supporting the recording element substrate is the best position for forming the buffer chamber.

Japanese Patent Application Laid-Open No. 2001-130004 discloses a construction of providing a buffer chamber on the side face of the ink supply opening of an alumina base plate. More specifically, around the ink supply opening on the surface of an alumina base plate on a surface thereof adhered with the recording element (chip), a hole communicating with the ink supply opening is formed in plural. It is further disclosed to form the buffer chamber by covering an upper part of this hole, by adhesion with the recording element.

However, the formation of the buffer chamber as disclosed in Japanese Patent Application Laid-Open No. 2001-130004 is associated with the following problem. When the buffer chamber is formed in the above mentioned adhering position with the chip, the area of adhesion (contact area) with the chip becomes smaller. In a recording element executing ink discharge particularly by the bubble jet system, the chip itself is heated by the heater, and the heat accumulated in the chip is dissipated through the contact area with the base plate. Therefore, when the contact area with the chip is made smaller by the formation of the buffer chamber, the speed of heat dissipation is reduced leading to problematical printing. In particular, recent recording elements, called for higher print resolution, higher print speed and a longer nozzle array, tend to cause problems in the printing, conspicuously as a consequence of the lowered heat dissipation speed.

Also recent developments are directed actively toward a compact recording element (chip) itself as a result of size reduction in the printer itself and in the recording head. For example, a method has already been devised to dispose plural nozzle arrays for different colors on a single recording element substrate, with a distance between the nozzle arrays as small as possible. However, in the construction of the buffer chamber disclosed in Japanese Patent Application Laid-Open No. 2001-130004, the buffer chamber becomes difficult to be disposed or is limited in the position thereof, by the presence of the adjacent nozzle.

Furthermore, the disposition of the buffer chamber disclosed in Japanese Patent Application Laid-open No. 2001-130004 is difficult to apply to a full multi-head or a multi-array nozzle head. Full multi-head means a recording head that has a nozzle array length of the recording element corresponding to the width of a recording sheet and that is used in a recording method in which the recording sheet is conveyed immediately under the recording head and is thus recorded. Also, multi-array nozzle head means a recording head including plural units of the nozzle array of a full-multi head.

SUMMARY OF THE INVENTION

The present invention is directed to a recording head providing an excellent high-speed response and an excellent discharge performance, and a recording apparatus equipped with the recording head.

According to an aspect of the present invention, a recording head includes a recording element substrate having a discharge port facilitating discharging a liquid droplet, an energy generating element configured to generate energy for liquid discharge and a supply opening facilitating supplying the discharge port with a liquid. The recording head also includes a support member having a supply path formed by laminating plural plate-shaped members including an opening portion and serving to support the recording element substrate and includes a chamber communicating with the supply path and adapted to hold air.

In the exemplary embodiment of the present invention, an air chamber for reducing the crosstalk phenomenon, encountered at the liquid discharging operation, is formed in the support member for supporting the recording element substrate. Therefore, even in case of forming plural arrays of discharge ports in the recording element substrate, the freedom in the arrangement of the air chamber is not deteriorated and the crosstalk phenomenon can be effectively reduced. It is also rendered possible to avoid the print defects, resulting from the decrease in the contact area between the support member and the recording element substrate.

Further features of the present invention will become apparent from the following description of exemplary embodiments with reference to the attached drawings.

DESCRIPTION OF THE EMBODIMENTS

In the following, an exemplary embodiment of the recording apparatus of the present invention will be described in detail, with reference to the accompanying drawings. The present invention will be described, utilizing an ink jet printer as an exemplary embodiment thereof.

In the exemplary embodiment of the present invention, "printing" (also referred to as "recording") is not limited to a case of forming information of a certain significance such as a character or graphics. In summary, it widely includes forming an image, a design, a pattern or the like on a printing medium or processing the medium, regardless of whether it is significant or insignificant, or is made visible so as to be recognizable by human visual sense.

Also "print medium or recording medium" means not only paper used in the ordinary printing apparatus, but also various materials capable of accepting ink, such as cloth, plastic film, metal plate and the like, glass, ceramics, wood, and leather, and the like.

Furthermore, "ink" (also referred to as "liquid") should be interpreted widely as in the case of "print". Thus, it means a liquid that can be deposited on the print medium and that can be used for forming an image, a design, a pattern or the like, for processing of the print medium, or for processing of the ink (for example solidification or insolubilization of a colorant in the ink deposited on the print medium.

Also, the present invention is applicable, in addition to an ordinary recording apparatus, to apparatuses such as a copying apparatus, a facsimile having a communication system, or a word processor having a printer portion, and to industrial recording apparatuses combined in a complex manner with various processing apparatuses.

(Main Body of Apparatus)

Figure 1:
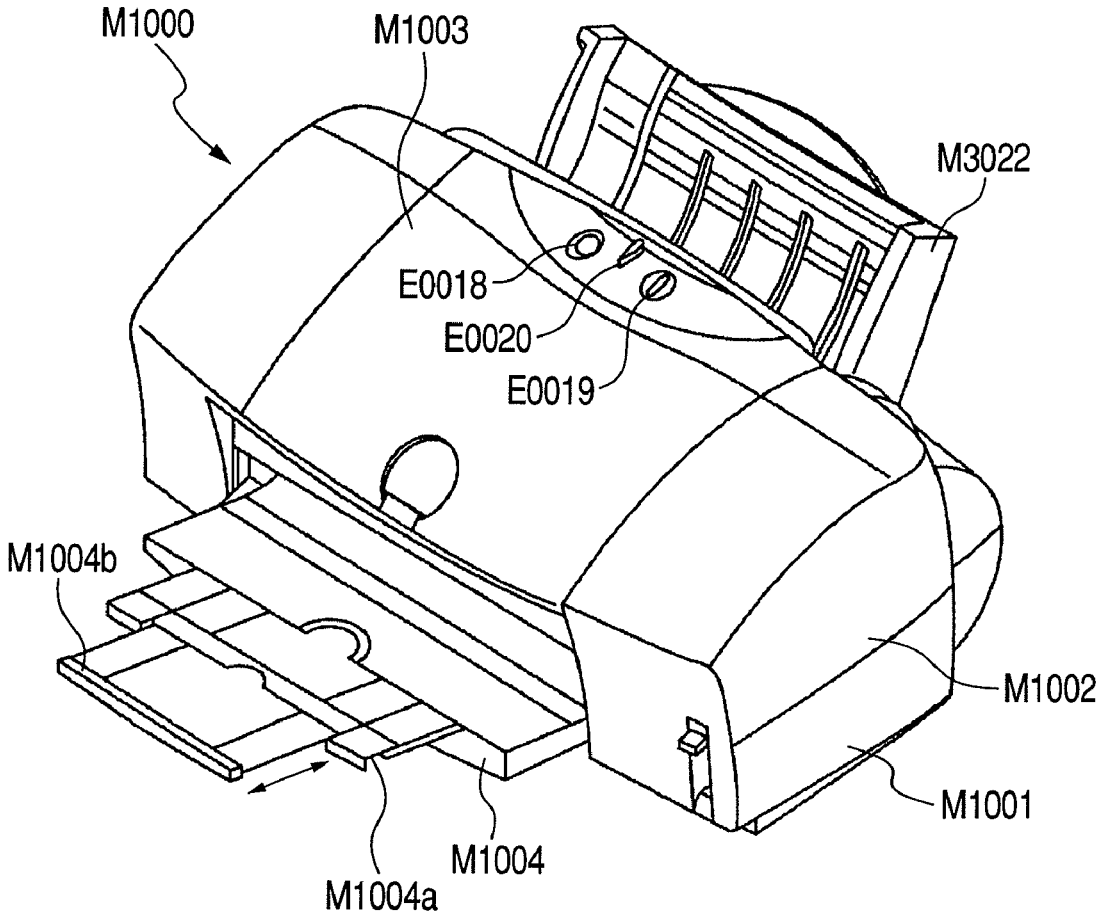
FIG. 1 is an external perspective view of a main body of an ink jet printer.
Figure 2:
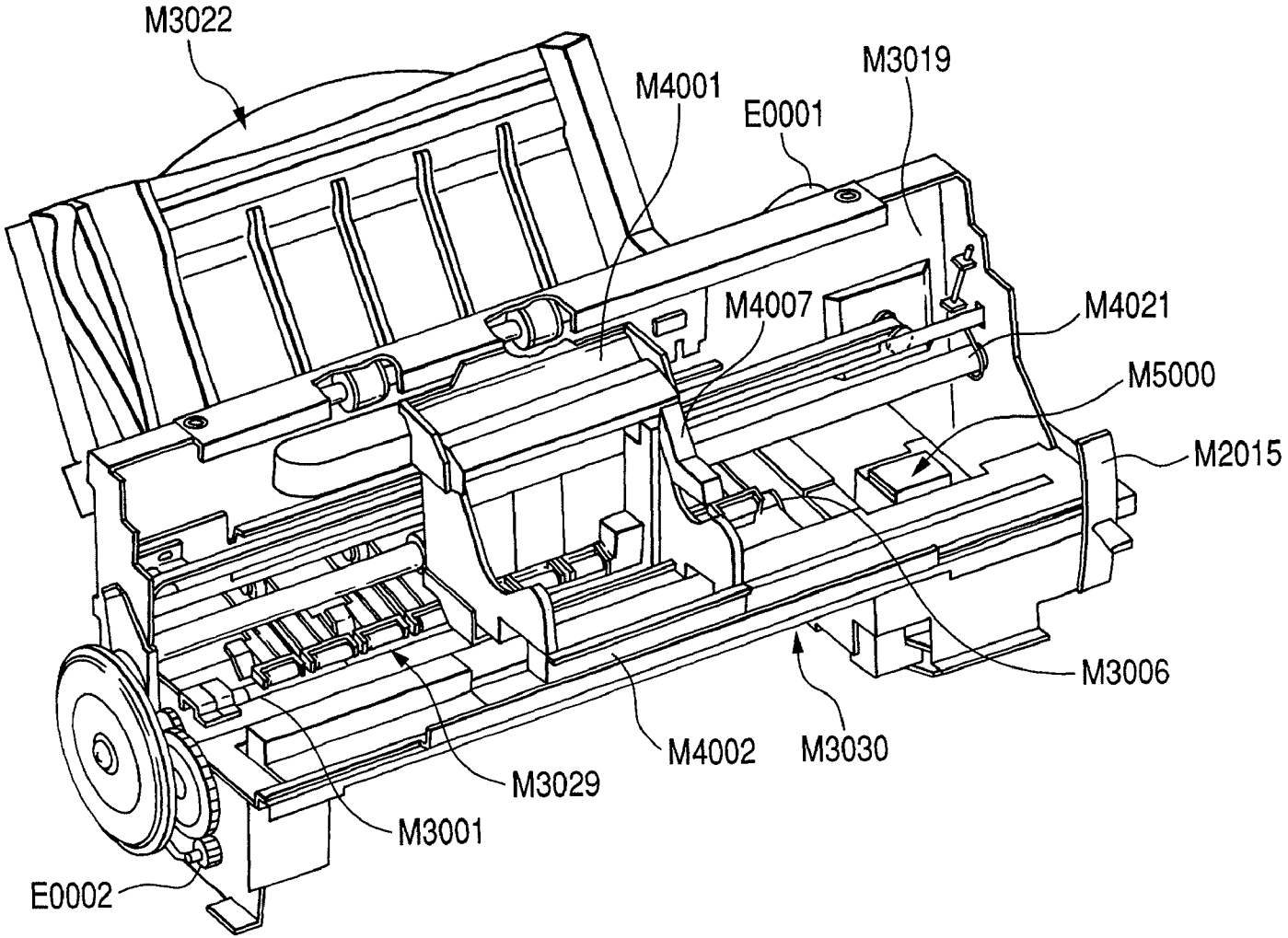
FIG. 2 is a perspective view of an internal structure of the main body of the ink jet printer illustrated in FIG. 1.

FIGS. 1 and 2 illustrate a schematic construction of a printer utilizing an ink jet recording system. An outer shell of the main body M1000 of the printer is constituted of an outer member and a chassis M3019 (cf. FIG. 2) accommodated in the outer member. The outer member includes a lower case M1001, an upper case M1002, an access cover M1003, and a discharge tray M1004.

The chassis M3019 is constituted of plural plate-shaped metal members having a prescribed rigidity, constitutes the skeleton of the recording apparatus, and supports mechanisms for recording operations to be described later. The lower case M1001 constitutes an approximate lower half of the outer shell of the main body M1000, and the upper case M1002 constitutes an approximate upper half of the outer shell of the main body M1000. The outer shell of the main body M1000 has, by the combination of the cases M1001 and M1002, a hollow structure having an accommodating space for accommodating therein various mechanisms to be described later. The main body M1000 has openings respectively in an upper surface portion and a front surface portion.

The discharge tray M1004 is rotatably supported at an end thereof by the lower case M1001, and is capable, by a rotation thereof, of opening or closing the opening formed in the front surface portion of the lower case M1001. Therefore, in case of executing a recording operation, the discharge tray M1004 is rotated to the front surface side to form the opening, whereby the recording sheet can be discharged and stacked thereon. Also, the discharge tray M1004 contains two auxiliary trays M1004*a*, M1004*b* that can be extended to the front side when necessary, whereby the supporting area for the sheet can be expanded or reduced in three levels.

The access cover M1003 is rotatably supported at an end thereof by the upper case M1002, and is thus capable of opening or closing the opening formed on the upper surface. By opening the access cover M1003, a recording head cartridge H1000 or an ink tank H1900 (cf. FIGS. 3 and 4) accommodated in the interior of the main body can be exchanged. Though not particularly illustrated, when the access cover M1003 is opened or closed, a projection formed on a rear surface thereof rotates a cover open/close lever. The rotational position of the cover open/close lever is detected for example by a microswitch to detect the open/close state of the access cover.

In a rear part on the upper surface of the upper case M1002, a power supply key E0018 and a resume key E0019 are disposed so as to be depressed, and a light-emitting diode E0020 is also disposed. When the power supply key E0018 is depressed, the light-emitting diode E0020 is turned on to inform the operator that the recording operation is enabled. Also, the light-emitting diode E0020 performs various display functions. For example, the operator is informed of printer trouble by an on/off mode and a color change. Also, there may be provided a buzzer which generates a sound in case of a problem. When the problem is resolved, the recording operation can be resumed by depressing the resume key E0019.

(Mechanisms for Recording Operation)

Now, mechanisms for recording operations, accommodated and held in the main body M1000 of the printer apparatus, will be described.

The recording mechanisms in the present exemplary embodiment include an auto feeding portion M3022, a conveying portion M3029, a recording portion, and a recovery portion M5000.

The auto feeding portion M3022 automatically feeds recording sheets into the main body M1000. The conveying portion M3029 guides the recording sheet fed out one by one from the auto feeding portion M3022 to a prescribed recording position, and guides the recording sheet from the recording position to the discharge portion M3030. The recording portion executes a prescribed recording on the recording sheet conveyed to the recording position. The recovery portion M5000 executes a recovery process on the recording portion.

As a supplementary description on the recording portion, the recording portion includes a carriage M4001 movably supported by a carriage shaft M4021, and a recording head cartridge H1000 detachably mounted on the carriage M4001.

Now, the recording head cartridge H1000 to be employed in the recording portion will be described in detail, with reference to FIGS. 3 to 5.

Figure 3:
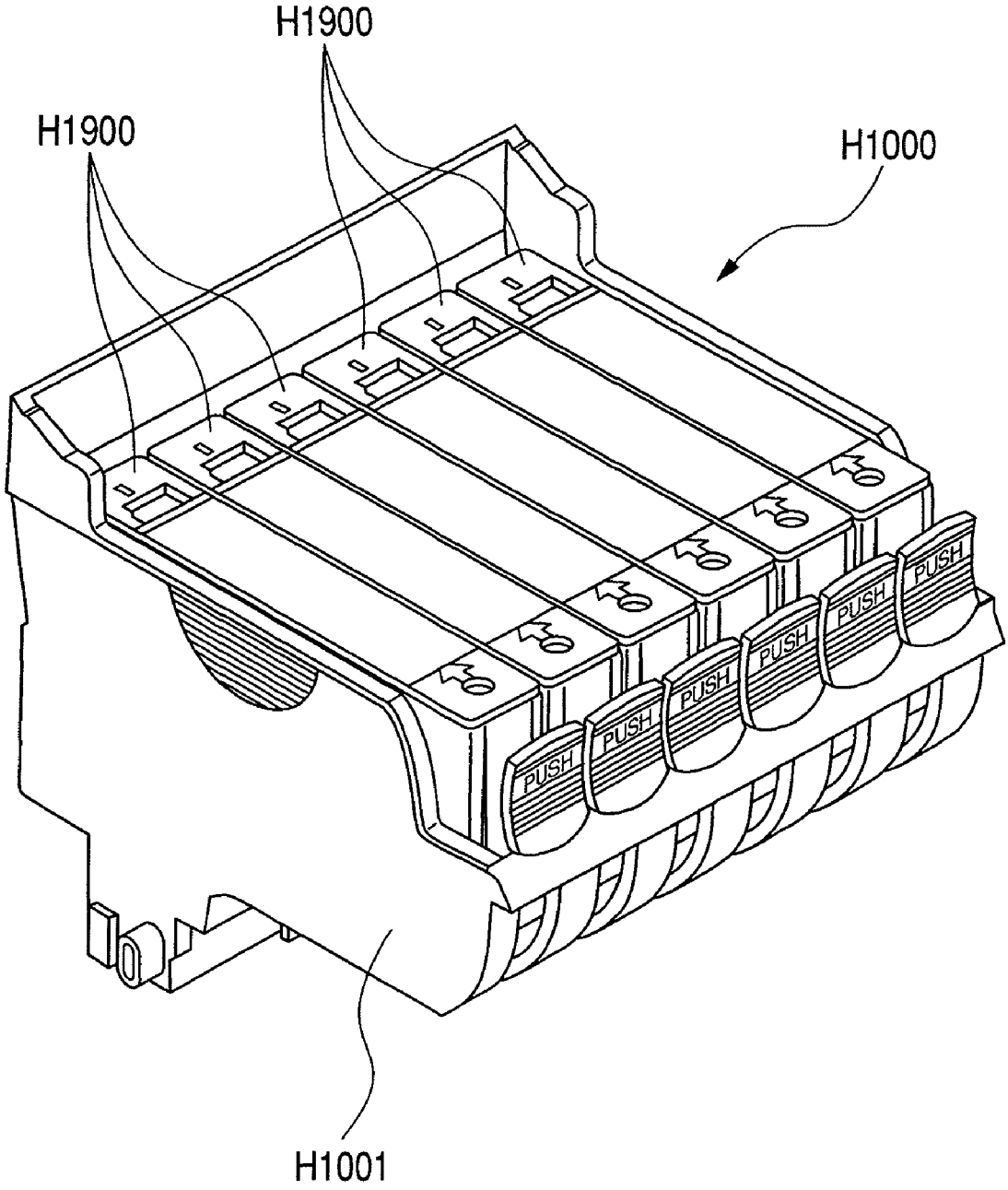
FIG. 3 is an external perspective view of a recording head cartridge equipped in the ink jet printer illustrated in FIG. 1.
Figure 4:
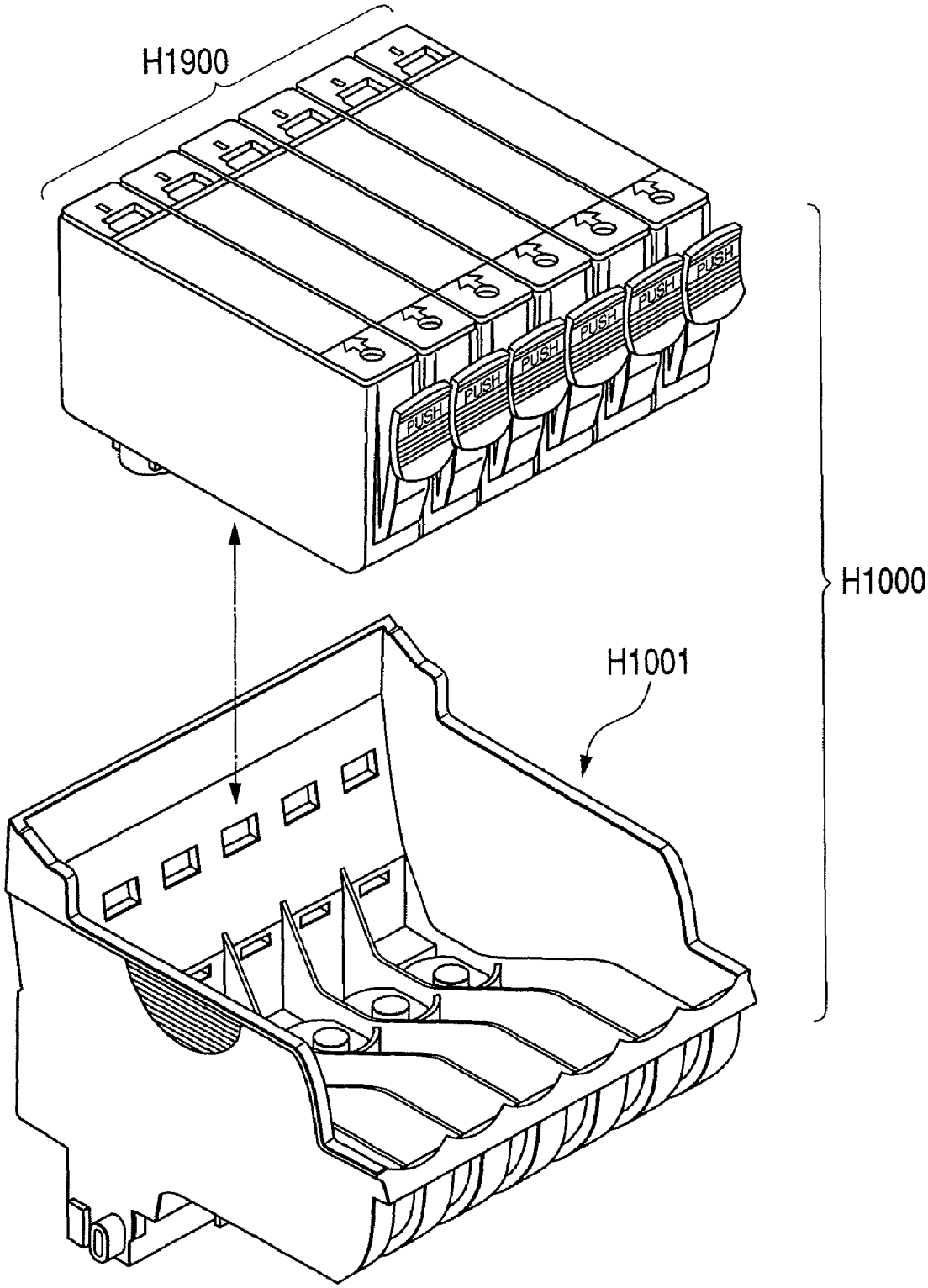
FIG. 4 is a perspective view of a state where an ink tank is detached from the recording head cartridge illustrated in FIG. 3.

The recording head cartridge H1000 in the present exemplary embodiment includes, as illustrated in FIG. 3, an ink tank H1900 storing the ink. It also includes a recording head H1001 for discharging the ink, supplied from the ink tank H1900, from discharge ports according to recording information. The recording head H1001 adopts a cartridge system, detachably mountable on the carriage M4001 (FIG. 2) to be described later.

In the illustrated recording head cartridge H1000, in order to enable a color recording of a photographic high image quality, an ink tank H1900 is provided independently for each color. More specifically, ink tanks H1900 are provided, respectively, for black, light cyan, light magenta, cyan, magenta, and yellow colors, for example. As illustrated in FIG. 4, each ink tank H1900 is independently detachably mounted on the recording head H1001.

Figure 5:
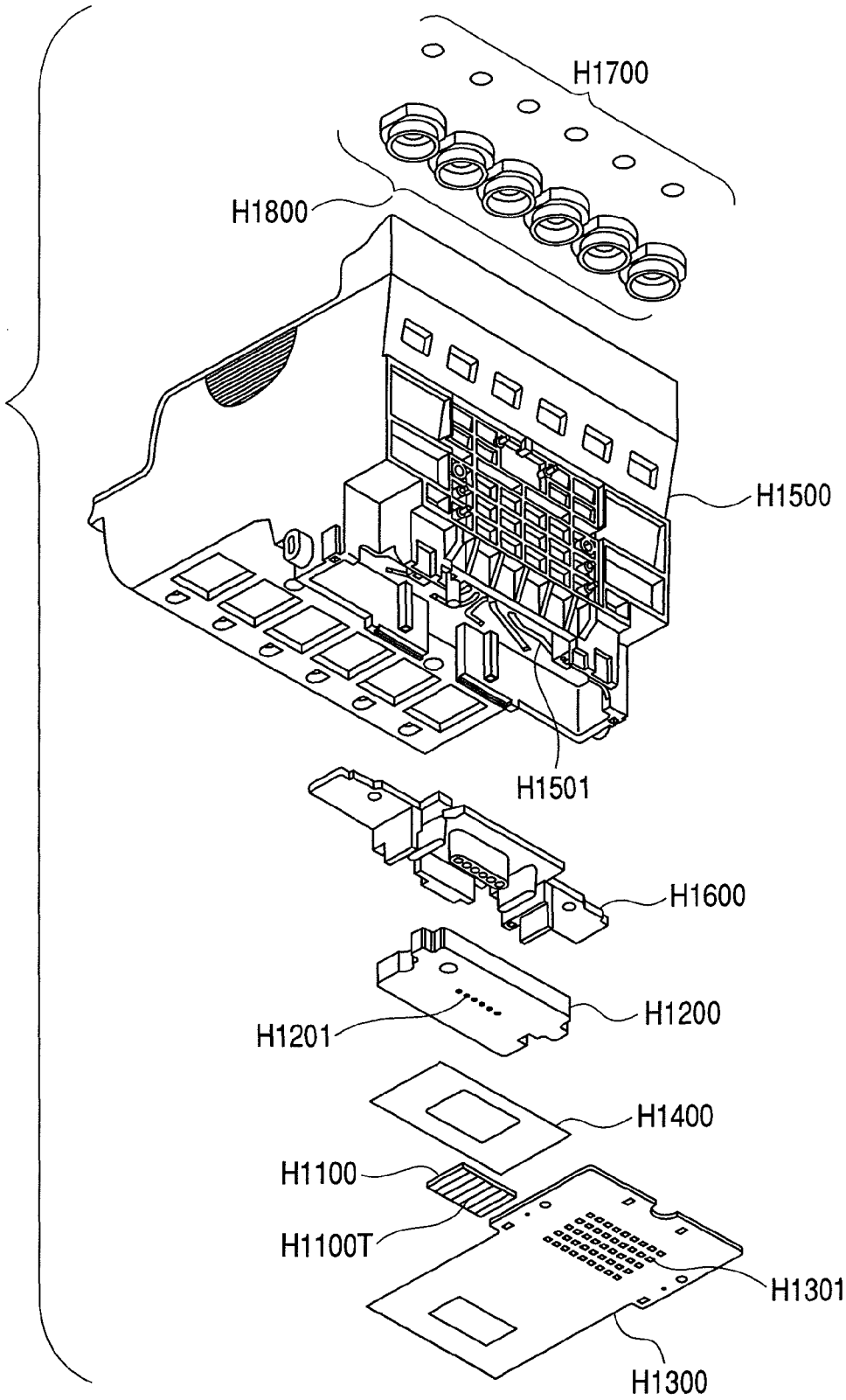
FIG. 5 is an exploded perspective view of a recording head constituting the recording head cartridge illustrated in FIG. 3.

The recording head H1001 includes, as illustrated in an exploded perspective view in FIG. 5, a recording element substrate H1100, a first plate H1200, and an electric wiring substrate H1300. The recording head further includes a second plate H1400, a tank holder H1500, a flow path forming member H1600, a filter H1700, and a sealing rubber H1800.

In the recording element substrate H1100, on a surface of an Si substrate, discharge energy generating elements (cf. FIG. 8) for generating energy for ink discharge and electric wirings, for example Al, for supplying the discharge energy generating elements with electric power are formed by a film forming technology.

Furthermore, plural ink flow paths respectively corresponding to the discharge energy generating elements, and plural discharge ports H1100T opposed to the discharge energy generating elements, are formed by a photolithographic technology. The plural discharge ports H1100T are so arranged as to form an array or plural arrays of the discharge ports. In addition, an ink supply opening for ink supply to the plural ink flow paths is opened on the rear surface. The recording element substrate H1100 is fixed by adhesion to the first plate H1200, in which an ink supply opening H1201 is formed for ink supply to the recording element substrate H1100. Further, the first plate H1200 is fixed by adhesion to the second plate H1400 having an opening. The second plate H1400 supports the electric wiring substrate H1300, in such a manner that the electric wiring substrate H1300 and the recording element substrate H1100 are electrically connected.

The electric wiring substrate H1300 serves to apply, to the recording element substrate H1100, electric signals for causing ink discharge. The electric wiring substrate H1300 includes electric wirings corresponding to the recording element substrate H1100, and external signal input terminals H1301, which are positioned at an end of the electric wirings and serve to receive an electrical signal from the main body. The external signal input terminals H1301 are positioned and fixed at the rear surface side of a tank holder H1500.

The flow path forming member H1600 is fixed on the tank holder H1500 by ultrasonic welding for example, and an ink flow path H1501 is formed extending from the ink tank H1900 to the first plate H1200. An end of the ink flow path H1501, at the ink tank side engaging with the ink tank H1900, is equipped with a filter H1700 in order to prevent intrusion of dust from the exterior. Also, a sealing rubber H1800 is mounted in the engaging part with the ink tank H1900, thereby preventing evaporation of ink from the engaging part.

As described above, a tank holder portion is constituted of the tank holder H1500, the flow path forming member H1600, the filter H1700, and the sealing rubber H1800. Also, the recording element portion is constituted of the recording element substrate H1100, the first plate H1200, the electric wiring substrate H1300, and the second plate H1400. Then, the tank holder portion and the recording element portion are coupled by ultrasonic welding for example to constitute the recording head H1001.

(Carriage)

In the following, the carriage M4001 for mounting the recording head cartridge H1000 will be described, with reference to FIG. 2.

The carriage M4001 is provided with a carriage cover M4002 for guiding the recording head H1001 to a predetermined mounting position on the carriage M4001. A head set lever M4007, which engages with the tank holder H1500 of the recording head H1001 and which presses the recording head H1001 for setting in the predetermined mounting position, is also provided. The head set lever M4007 is provided on an upper part of the carriage M4001, rotatably about a head set lever shaft. In the engaging part with the recording head H1001, a head set plate (not illustrated) urged by a spring is provided through a spring, and the recording head H1001 is mounted on the carriage M4001 under pressure by the spring force.

Also, in another engaging part of the carriage M4001 with the recording head H1001, a contact flexible printed cable (hereinafter referred to as contact FPC) is provided. A contact portion on the contact FPC and a contact portion (external signal input terminals H1301) provided in the recording head H1001 form an electrical contact, for executing exchange of various information for recording and an electric power supply to the recording head H1001.

Between the contact portion of the contact FPC and the carriage M4001, an unillustrated elastic member, such as of rubber, is provided. The elastic force of the elastic member and the pressing force by the head set lever spring realize a secure contact between the contact portion and the carriage M4001.

The contact FPC is further connected to a carriage substrate (not illustrated) mounted on the rear side of the carriage M4001.

(Functions of Printer)

Figure 6:
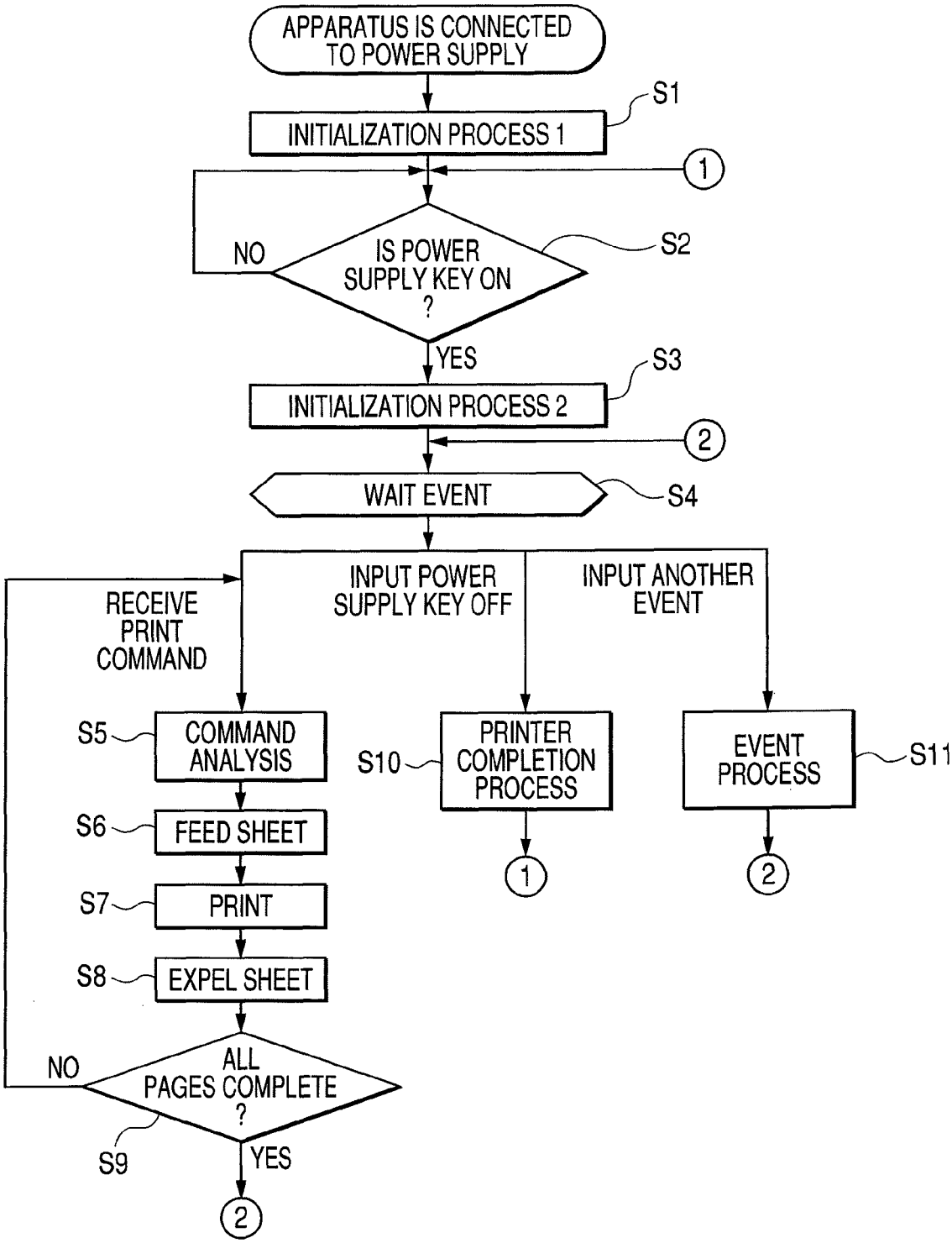
FIG. 6 is a flow chart illustrating an operation flow of the ink jet printer illustrated in FIG. 1.

In the following, functions of the printer of the present exemplary embodiment, constructed as described above, will be described with reference to a flow chart in FIG. 6.

When the main body 1000 of the apparatus is connected to an AC power supply, at first, a step S1 executes a first initialization of the apparatus. This initialization process checks the electrical system such as ROM and RAM of the apparatus, thus confirming that the apparatus is electrically operating normally.

Then a step S2 discriminates as to whether a power supply key E0018, disposed on the upper case M1002 of the main body M1000, has been turned on, and the sequence proceeds to a step S3 when the power supply key E0018 is turned on. The step S3 executes a second initialization.

The second initialization checks various driving mechanisms and the recording head of the apparatus. More specifically, in executing initialization of motors and reading head information, it is confirmed that the apparatus is operable in a normal manner.

Then, a step S4 awaits an event. More specifically, this step monitors a command event from an external I/F, a panel key event by a user operation, and an internal control event. In the case that an event is generated, a process corresponding to this event is executed. For example, in the case that the step S4 receives a print command event from the external I/F, the sequence proceeds to a step S5. Also in the case of a power supply key event by a user operation, the sequence proceeds to a step S10. For other events, the sequence proceeds to a step S11.

The step S5 analyzes the print command from the external I/F, thereby determining a sheet type, a sheet size, a print quality, a sheet feeding method designated, and stores the results of determination in a RAM in the apparatus. Then, the sequence proceeds to a step S6. The step S6 initiates sheet feeding by the feeding method designated in the step S5, and advances the sheet to a recording start position, whereupon the sequence proceeds to a step S7. The step S7 executes a recording operation.

In the recording operation, recording data transmitted from the external I/F are once stored in a recording buffer. Then, a CR motor E0001 (FIG. 2) is activated to initiate a displacement of the carriage M4001 (FIG. 2) in the main scanning direction. At the same time, the recording data stored in the print buffer are supplied to the recording head H1001, thereby executing a recording of a line. When the recording operation of the recording data of one line is complete, an LF motor E0002 (FIG. 2) is activated to rotate an LF roller M3001 (FIG. 2), thereby advancing the sheet in the sub scanning direction. The above-described operations are thereafter repeated, and, when the recording of recording data of one page from the external I/F is completed, the sequence proceeds to a step S8.

In the step S8, the LF motor E0002 (FIG. 2) is activated to drive a discharge roller, and the sheet conveying is repeated until the sheet is detected to have been discharged completely from the apparatus. When the sheet conveying is completed, the sheet reaches a state of a complete discharge on the discharge tray M1004 (FIG. 1).

Then a step S9 discriminates as to whether the recording operation for all the pages to be recorded is completed, and, in the case that any page to be recorded still remains, the sequence returns to the step S5. Thereafter, the operations of the above mentioned steps S5 to S9 are repeated, and the recording operation is terminated when the recording operation for all the pages to be recorded is completed, whereupon the sequence returns to the step S4 for awaiting a next event.

On the other hand, the step S10 executes a printer end process to terminate the function of the apparatus. It shifts to a state capable of turning off the power supply in order to turn off the power supply in the motors and recording head, and then turns off the power supply, whereupon the sequence proceeds to the step S4 for awaiting a next event.

Also, the step S11 executes a process for events other than described above. For example, it executes a process corresponding to a recovery command from panel keys of the present apparatus or from the external I/F, or to an internally generated recovery event, whereupon the sequence proceeds to the step S4 for awaiting a next event.

Now, there will be given a detailed description on the construction particularly of the recording head H1001 in the printer of the present exemplary embodiment.

Figure 7:
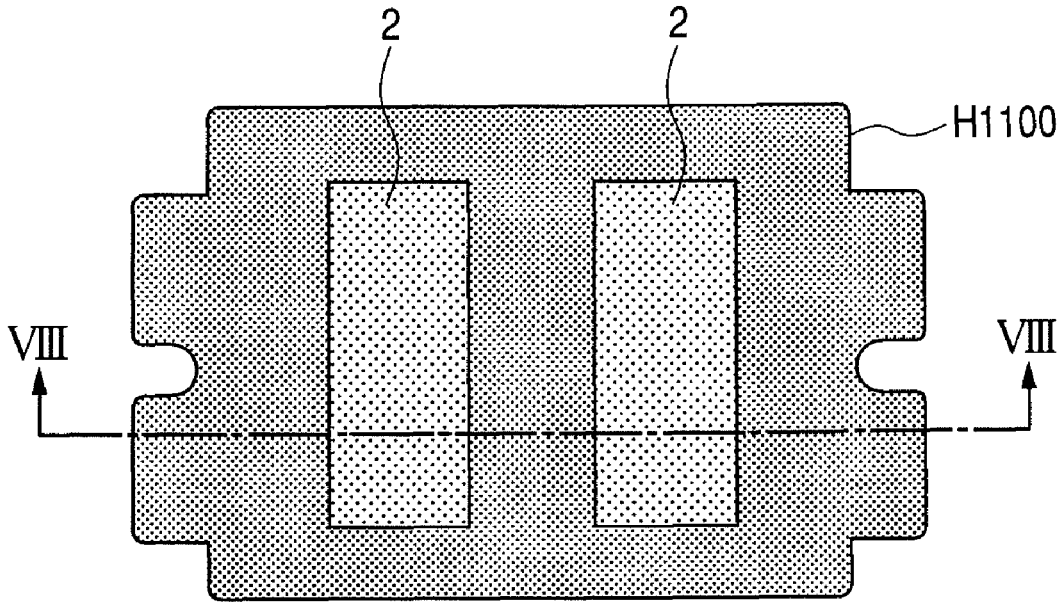
FIG. 7 is a schematic plan view of a region near the recording element substrate, constituting the recording head illustrated in FIG. 5.
Figure 8:
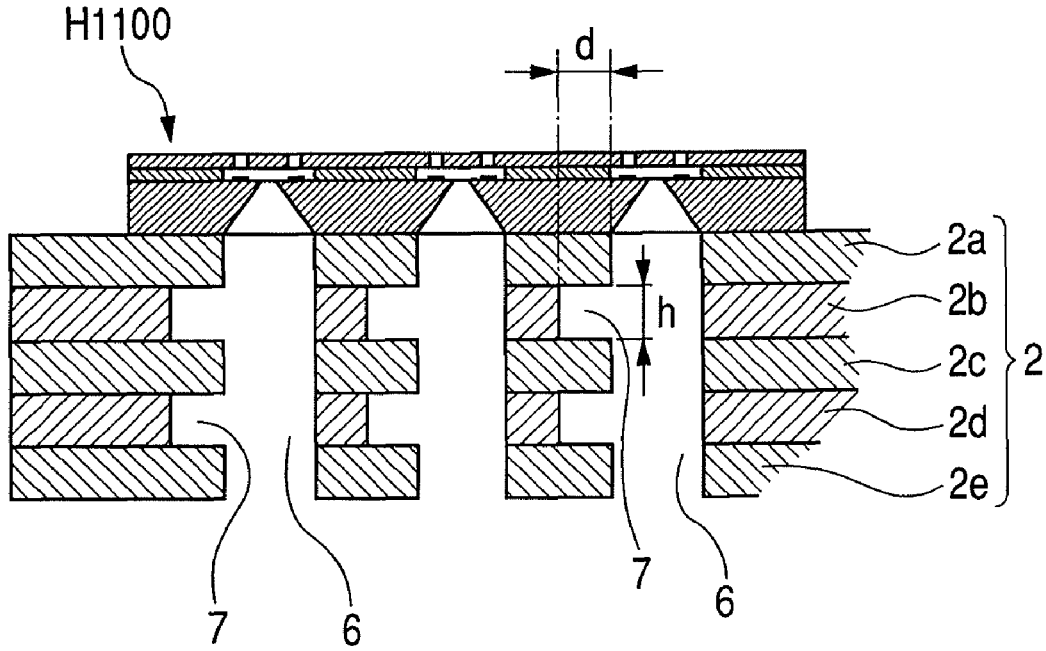
FIG. 8 is a cross-sectional view along a line VIII-VIII in FIG. 7.

FIG. 7 illustrates an ink flow path in the vicinity of the recording element substrate H1100 in the recording head H1001, and FIG. 8 is a perspective view illustrating the construction of the support member 2 for supporting the recording element substrate H1100.

The support member 2 is formed by alumina ($Al_2O_3$). However, it may also be formed by a material other than alumina, such as silicon, aluminum nitride, zirconia, silicon nitride, molybdenum, or tungsten. It can be a material having a linear expansion coefficient equivalent to that of the material constituting the recording element substrate H1100.

The support member 2 of the present exemplary embodiment was prepared in the following manner. In advance, plural alumina sheets 2*a*, 2*b*, 2*c*, 2*d* and 2*e* were formed in the shape of the support member 2 by a sintering process or a cutting process. The processed alumina sheets 2*a*, 2*b*, 2*c*, 2*d* and 2*e* were integrated by sintering in a laminated state, in an oven of about 1500° C. Such method of process will be called, in the present specification, "laminated state processing".

Each of the alumina sheets 2*a*, 2*b*, 2*c*, 2*d* and 2*e* has a thickness of from 0.1 to 1 mm for example, but the thicknesses of the alumina sheets may be uniform or uneven. Stated differently, the alumina sheets of different thicknesses may be laminated in a random manner. Also, the illustrated alumina sheets 2*b* and 2*d* may be replaced by aluminum sheets which are improved in liquid contact property, by an anodizing process on the surfaces. It is also conceivable to obtain a support member 2 of a satisfactory thermal conducting efficiency by adhering the alumina sheets 2*a*, 2*b*, 2*c*, 2*d* and 2*e* with an adhesive material such as silicone. The same applies to the case where the sheet-shaped members constituting the support member 2 are formed by a material other than alumina.

As illustrated in FIG. 8, the support member 2 includes an ink supply path 6 for ink supply to the recording element substrate H1100, and plural air chambers 7 are formed on a side face of the supply path 6. The air chamber 7 can have a depth (d) of 1 mm or larger and a height (h) of 1 mm or less. The depth (d) of the air chamber 7 means a minimum dimension of the air chamber 7 in a direction perpendicular to the laminating direction of the alumina sheets, as will be obvious from the drawing. Also, the height (h) of the air chamber 7 means a minimum dimension of the air chamber 7 in the laminating direction of the alumina sheets.

Figure 9:
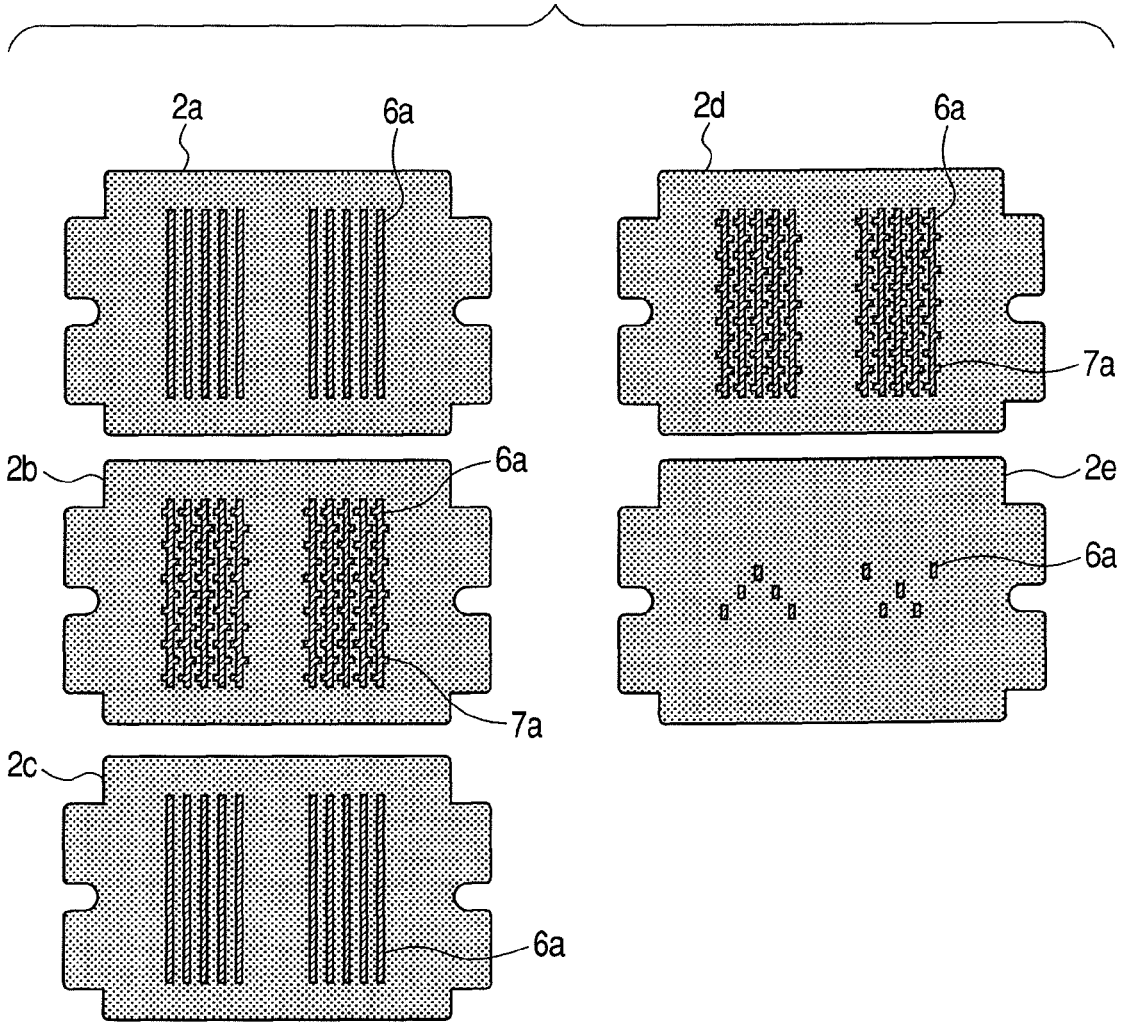
FIG. 9 is a schematic plan view of alumina plates constituting the support member.
Figure 10:
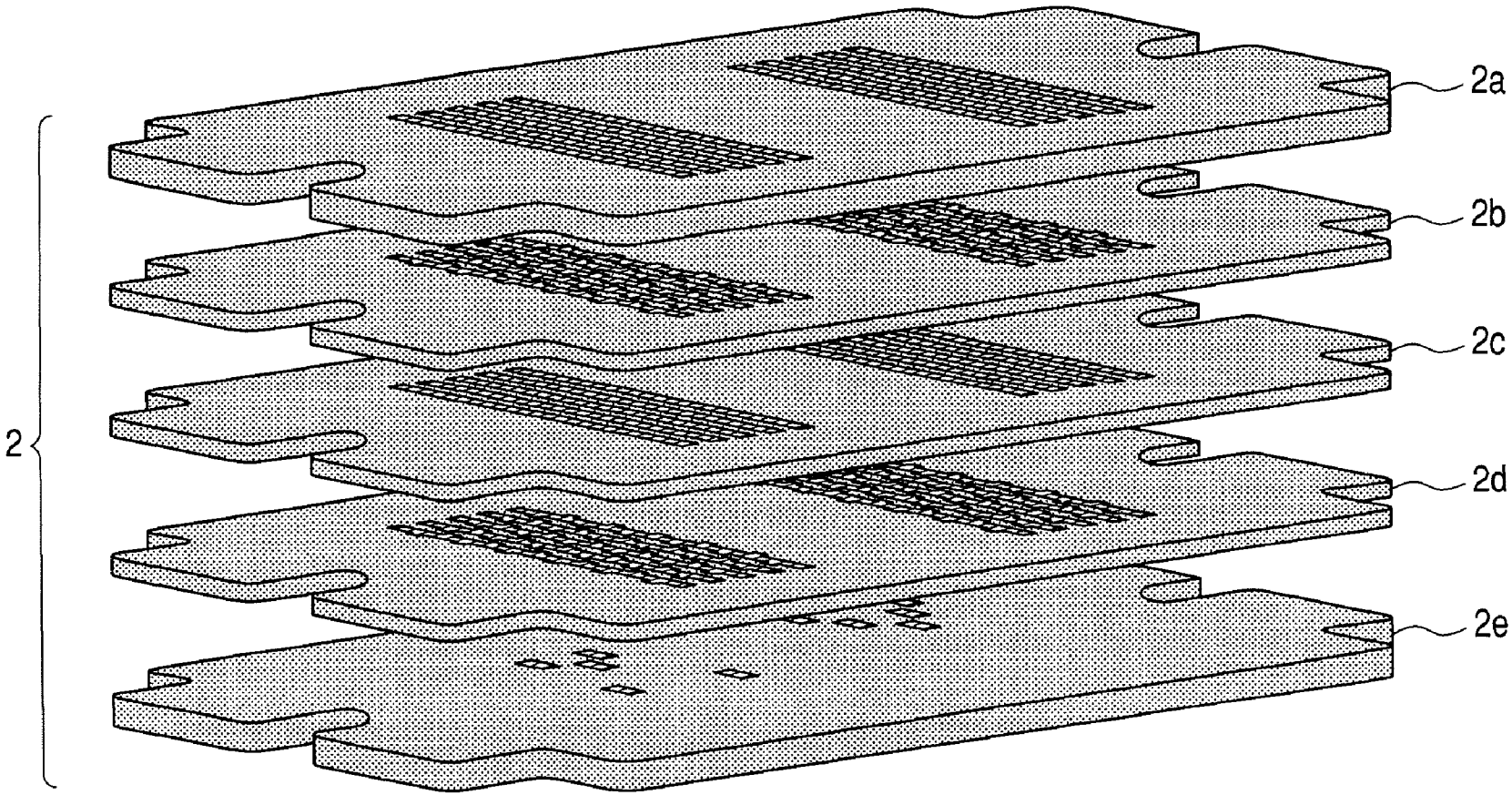
FIG. 10 is a schematic perspective view illustrating a laminated state of the alumina plates illustrated in FIG. 9.

The ink supply path 6 and the air chamber 7 mentioned above are formed in the following manner. In the alumina sheets 2*a*, 2*b*, 2*c*, 2*d* and 2*e*, stripe-shaped apertures 6*a* are formed as illustrated in FIG. 9. Also, the shape of the apertures 6*a* in a part of the alumina sheets is made different from that in other sheets. For example, in the apertures 6*a* in the sheets 2*b* and 2*d*, there are formed concave grooves 7*a*, recessed in a direction crossing the longitudinal direction of the apertures 6*a*. Thus, when the support member 2 is completed by laminating and sintering the alumina sheets 2*a*, 2*b*, 2*c*, 2*d* and 2*e* as illustrated in FIG. 10, the apertures 6*a* communicate with one another to form the ink supply paths 6 (FIG. 8). At the same time, air chambers 7 (FIG. 8) are formed by the concave grooves 7*a*, on the side face of thus formed ink supply paths 6.

In the case that the recording element substrate H1100 has a long nozzle array (in case of a long head), it is advantageous, for preventing the crosstalk, to form the air chambers uniformly along the direction of the nozzle array.

It is also possible, as illustrated in FIG. 8, to form plural air chambers 7 along the depth direction (vertical direction) of the support substrate. As the air chambers for buffer function, it is advantageous to provide the air chamber with a larger volume, closer to the discharge energy generating element. According to the exemplary embodiment of the present invention, plural air chambers can be formed in the depth direction of the support substrate, and it is thus rendered possible to provide a head having a buffer function, without increasing the dimension of the head.

Figure 11:
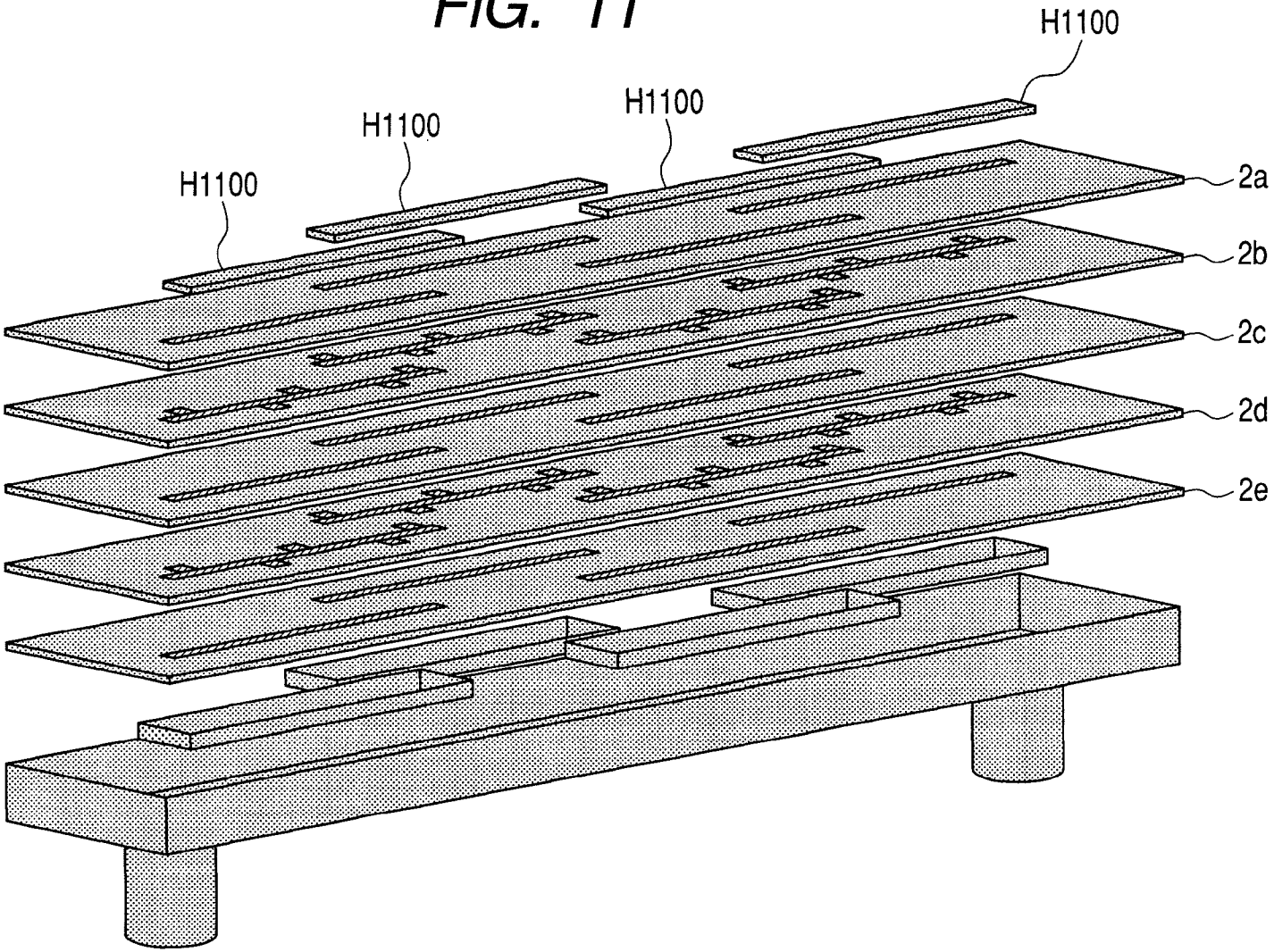
FIG. 11 is a schematic cross-sectional view illustrating an example construction of a full multi-head.
Figure 12A:
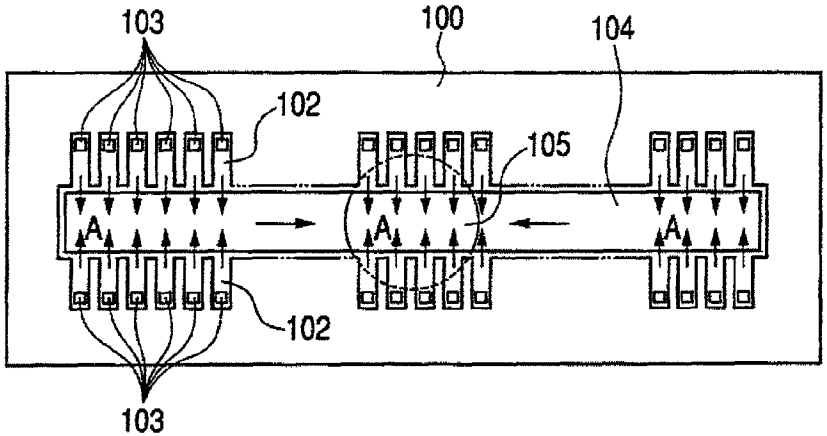
FIG. 12A (PRIOR ART)
FIGS. 12A and 12B are views describing pressure in a direction toward the supply opening, generated by an ink discharge.
Figure 12B:
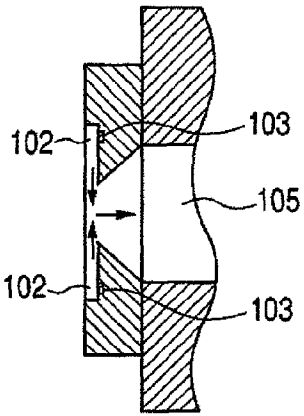
FIG. 12B (PRIOR ART)
Figure 13A:
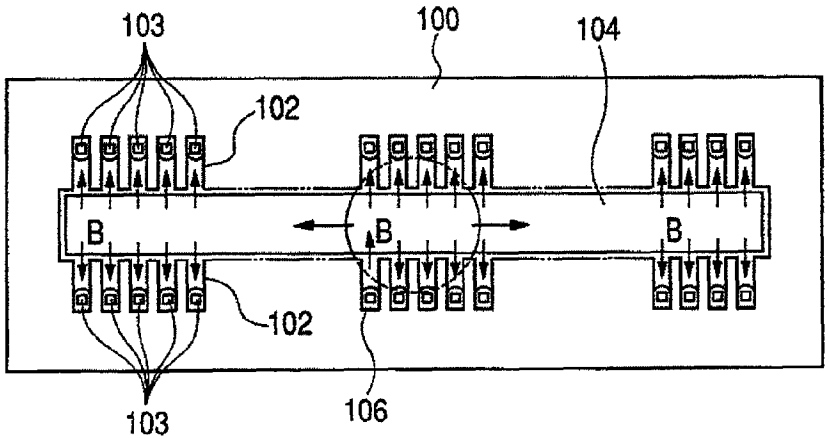
FIG. 13A (PRIOR ART)
FIGS. 13A and 13B are views illustrating pressure at an ink refilling.
Figure 13B:
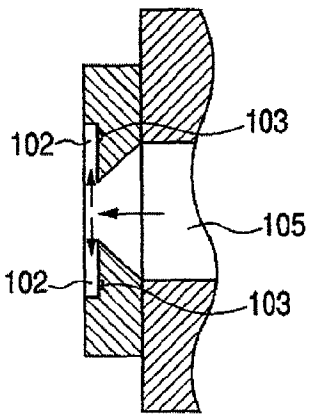
FIG. 13B (PRIOR ART)
Figure 14A:
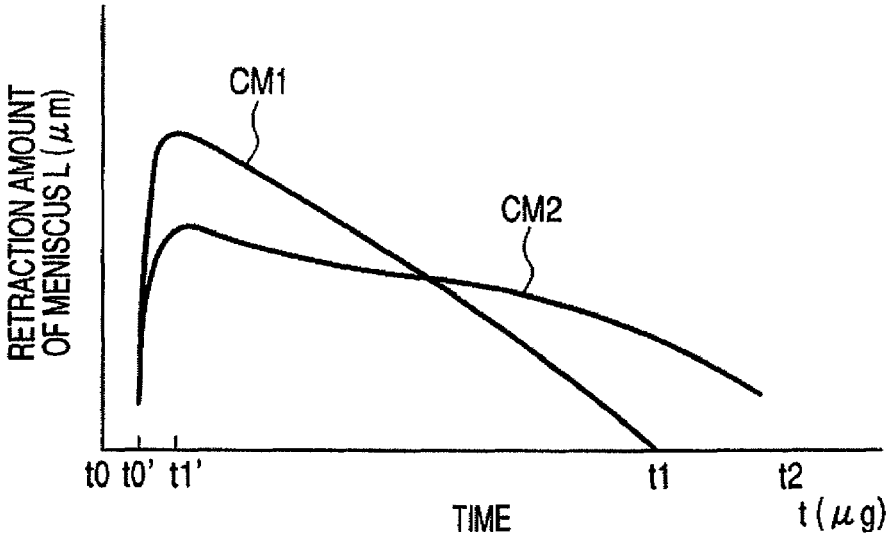
FIG. 14A (PRIOR ART)
FIGS. 14A and 14B are views illustrating a change in time of a meniscus retraction.
Figure 14B:
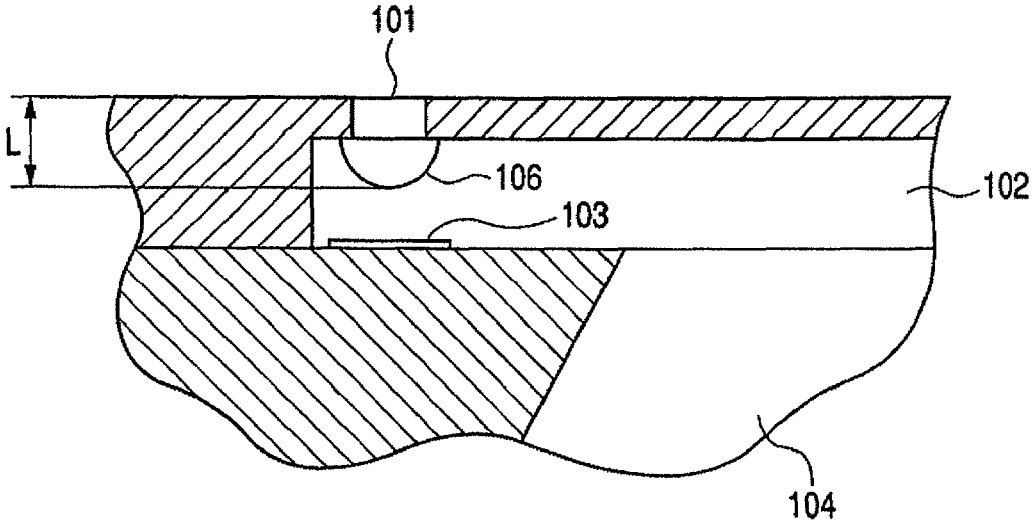
FIG. 14B (PRIOR ART)

Also, in the case of a recording head having plural recording element substrates H1100 as illustrated in FIG. 11, air chambers can be formed by employing the process of forming the support member by a laminating process as in the present exemplary embodiment. Therefore, the present invention is applicable also to a full-multi head that has a nozzle array length corresponding to the width of a recording sheet and that is used in a recording method in which the recording sheet is conveyed immediately under the recording head and is thus recorded.

Furthermore, the arrangement of the air chambers 7, as illustrated in FIG. 9 in a staggered manner and in a zigzag manner also in the depth direction (in such a manner that the air chambers do not overlap in the laminating direction), enables a further space saving, advantageous for making the head compact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-335656, filed Dec. 13, 2006, which is hereby incorporated by reference herein in its entirety.

What is claimed is:

1. A recording head comprising:

a recording element substrate having:

a discharge port facilitating discharging a liquid droplet;

an energy generating element configured to generate energy for liquid discharge; and a supply opening facilitating supplying the discharge port with a liquid; and a support member having a supply path formed by laminating a plurality of plate-shaped members including an opening portion, the support member supporting the recording element substrate, wherein the support member includes a plurality of air chambers communicating with the supply path and adapted to hold air, wherein the air chambers are formed in a plural number in the laminating direction of the plate-shaped members, and wherein the air chambers are formed in a plural number so as not to overlap in the laminating direction of the plate-shaped members.

2. A recording head according to claim 1, wherein the air chambers are formed by the opening portions that are different in shape.

3. A recording head according to claim 1, wherein the air chambers are formed on a side face of the supply path.

4. A recording head according to claim 1, wherein the air chambers have a length, in the laminating direction of the plate-shaped members, of 1 mm or less.

5. A recording head according to claim 1, wherein the air chambers have a length, in a direction crossing the laminating direction of the plate-shaped members, of 1mm or larger.

6. A recording head according to claim 1, wherein the recording element substrate includes a plurality of arrays of discharge ports, and the support member includes the plurality of supply paths of a number corresponding to the number of the arrays of the discharge ports.

7. A recording apparatus comprising a recording head according to claim 1, and a liquid tank containing a liquid to be supplied to the recording head.

* * * * *